United States Patent [19]

Ruark et al.

[11] 4,065,027

[45] Dec. 27, 1977

[54] HINGE ARRANGEMENT FOR ROOM AIR CONDITIONER ACCESS DOOR

[75] Inventors: Bruce J. Ruark; Richard L. Shaner, both of Louisville, Ky.

[73] Assignee: General Electric Company, Louisville, Ky.

[21] Appl. No.: 786,111

[22] Filed: Apr. 11, 1977

[51] Int. Cl.[2] ..... B65D 43/14; B65D 51/04

[52] U.S. Cl. ..... 220/343; 16/128 R; 16/173

[58] Field of Search ..... 220/343, 128 R, 173, 220/176

[56] References Cited

U.S. PATENT DOCUMENTS 2,762,076 9/1956 Kiba ..... 220/343

3,991,905 11/1976 Nicpon ..... 220/343

*Primary Examiner*—George T. Hall

*Attorney, Agent, or Firm*—Frank P. Giacalone; Francis H. Boos

[57] ABSTRACT

A method and apparatus for hingedly mounting a room air conditioner control access cover on a panel member. The present invention relates to a hinge including support and hinge members formed integrally with the panel and cover respectively, and more particularly to an arrangement wherein notches in the support members line up with a slot in the hinge member to form a continuous channel for receiving a hinge pin in the closed cover position and for retaining the cover on the panel when the cover is rotated from its closed position.

5 Claims, 8 Drawing Figures

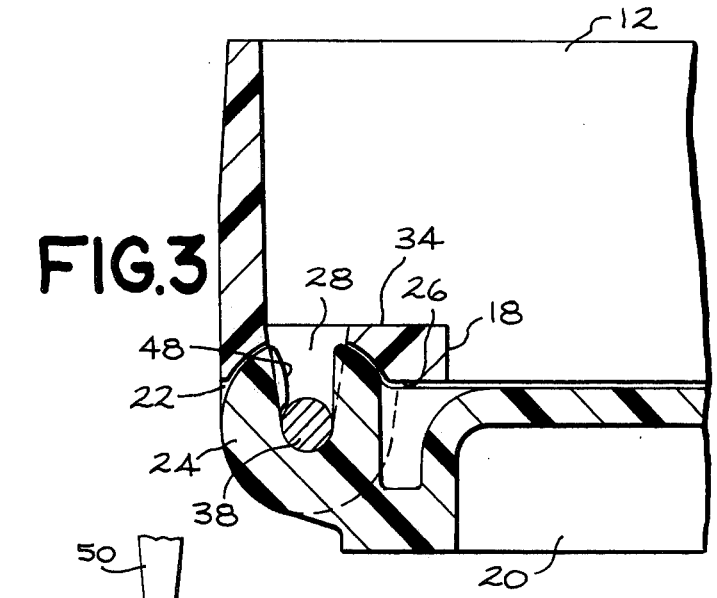
FIG.3
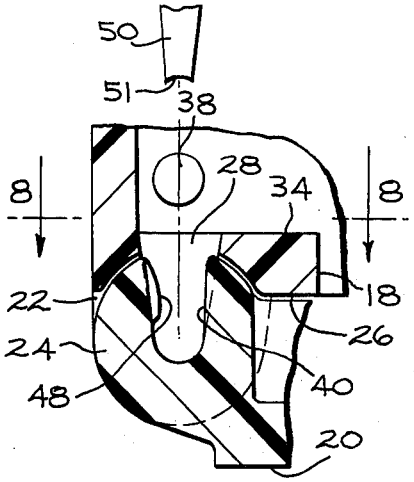
FIG. 6
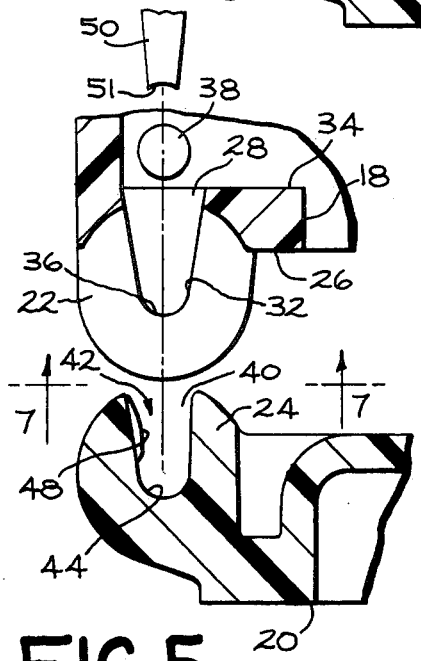
FIG.5
FIG.4
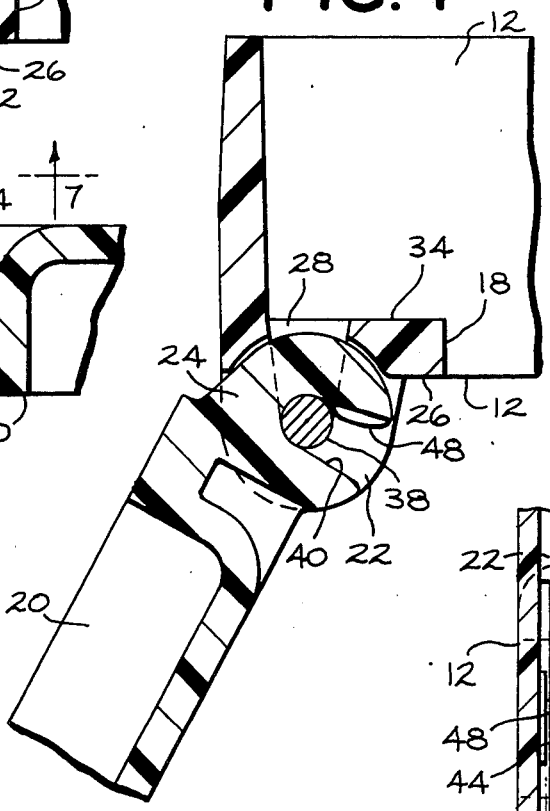
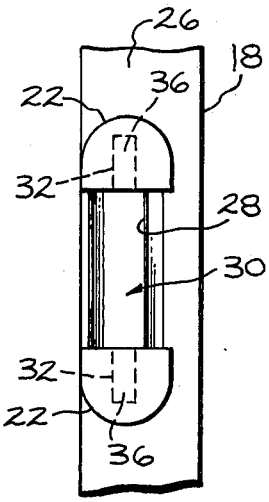
FIG.7
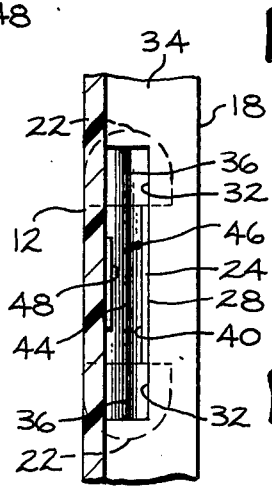
FIG.8

HINGE ARRANGEMENT FOR ROOM AIR CONDITIONER ACCESS DOOR

BACKGROUND OF THE INVENTION

This invention relates to an arrangement and method for hingedly mounting an access cover used in room air conditioning units for covering the unit's control panel. More particularly, the invention relates to a hinge wherein both the movable and stationary portions of the hinge are formed integrally with the cover and grill portion of the front panel respectively and the cover is rotatably secured to the panel by inserting the pivot or hinge pin in a channel arranged in the movable and stationary portions of the hinge.

Prior hinge arrangements such as U.S. Pat. No. 2,605,926—Casey provide arrangements wherein the hinge parts are formed integral with the stationary and rotatable members. The rotatable member is provided with a forked lug that is removably snapped onto a pivot or hinge pin on the stationary member. In this arrangement, the movable member can be removed in its open or closed position. U.S. Pat. No. 3,946,206—Utz provides a hinge arrangement similar to the Casey disclosure that incorporates a flap member on the movable cover that snaps over the hinge pin on the stationary member. This patent further provides a spring having the shape of a cylinder sector that fits tightly over the flap to prevent its removal from the hinge pin.

SUMMARY OF THE INVENTION

By this invention, there is provided a method and apparatus for hingedly mounting a room air conditioner control access cover on a panel member. The hinge arrangement includes a pair of support members on the panel spaced to provide a receiving area for a hinge member on the cover. The support members include notches which open into the rear wall of the panel with their open, axially-disposed ends extending into the receiving area. The hinge member is provided with a slot which is arranged to be in axial alignment with the axially-disposed open ends of the notches to form a continuous channel which is accessible from the rear wall of the panel when the cover hinge member is arranged in the receiving area in its closed position. A hinge pin is inserted in the channel for allowing rotational movement of the cover relative to the panel while preventing removal of the cover from the panel when the cover rotates from its closed position because the pivot pin is trapped between the hinge member and the support members as the slot opening in the hinge member forming the central portion of the channel is disposed from the notch opening forming the end portion of the channel.

BRIEF DESCRIPTION OF THE DRAWINGS

FIG. 3 is a sectional view taken along lines 3—3 of FIG. 1;

FIG. 4 is a view similar to FIG. 3 with the cover shown in its open position;

FIG. 5 is a plan view similar to FIG. 4 showing a step of the method of assembling the present hinge assembly;

FIG. 6 is similar to FIG. 5 showing another step of the method;

FIG. 7 is a fragmentary elevational view taken along lines 7—7 of FIG. 5; and

FIG. 8 is a fragmentary elevational view taken along lines 8—8 of FIG. 6.

DESCRIPTION OF THE PREFERRED EMBODIMENT

Figure 1:
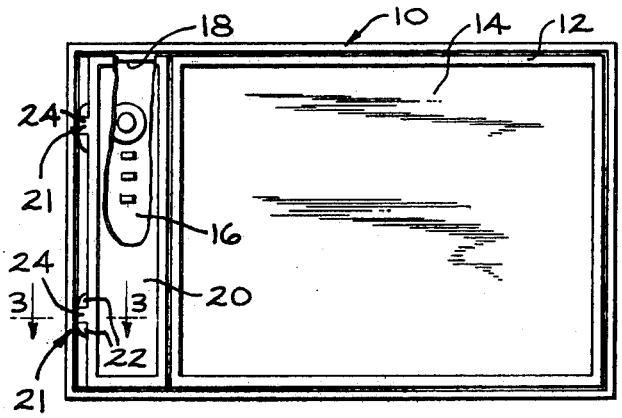
FIG. 1 is a front elevational view of a room air conditioner incorporating the hinge arrangement of the present invention.

Referring to FIG. 1, there is shown a room air conditioner 10 which includes a front panel assembly 12. The front panel 12 is provided with a grill portion 14 which allows air to enter from the room or area to be conditioned and the conditioned air to return to the room. The air conditioner 10 includes controls 16 which are generally arranged to be accessible from the front of the unit and accordingly the panel 12 is provided with an opening 18 through which the controls 16 may be set.

In order to protect the controls 16 from being inadvertently repositioned or for appearance purposes, a cover 20 may be provided to limit access to the controls. When a cover 20 is provided, it is generally hinged so that the controls 16 may be conveniently exposed by rotating the cover 20 to its open position.

By the present invention a hinge arrangement or assembly 21 is provided wherein the stationary portion of the hinge associated with panel 12 and the rotatable portion of the hinge associated with the cover 20 are conveniently moulded as part of the panel 12 and cover 20 respectively. Referring now to FIG. 1 of the drawings, it will be seen that two hinge assemblies 21 are provided along one vertical edge of the cover 20. Since the assemblies 21 are identical, only one will be described hereinafter in detail.

Referring now to FIGS. 2–8 of the drawings, each of the hinge assemblies 21 includes a pair of support members 22 formed integral with the panel 12 and a hinge member 24 formed integral with the cover 20.

Figure 2:
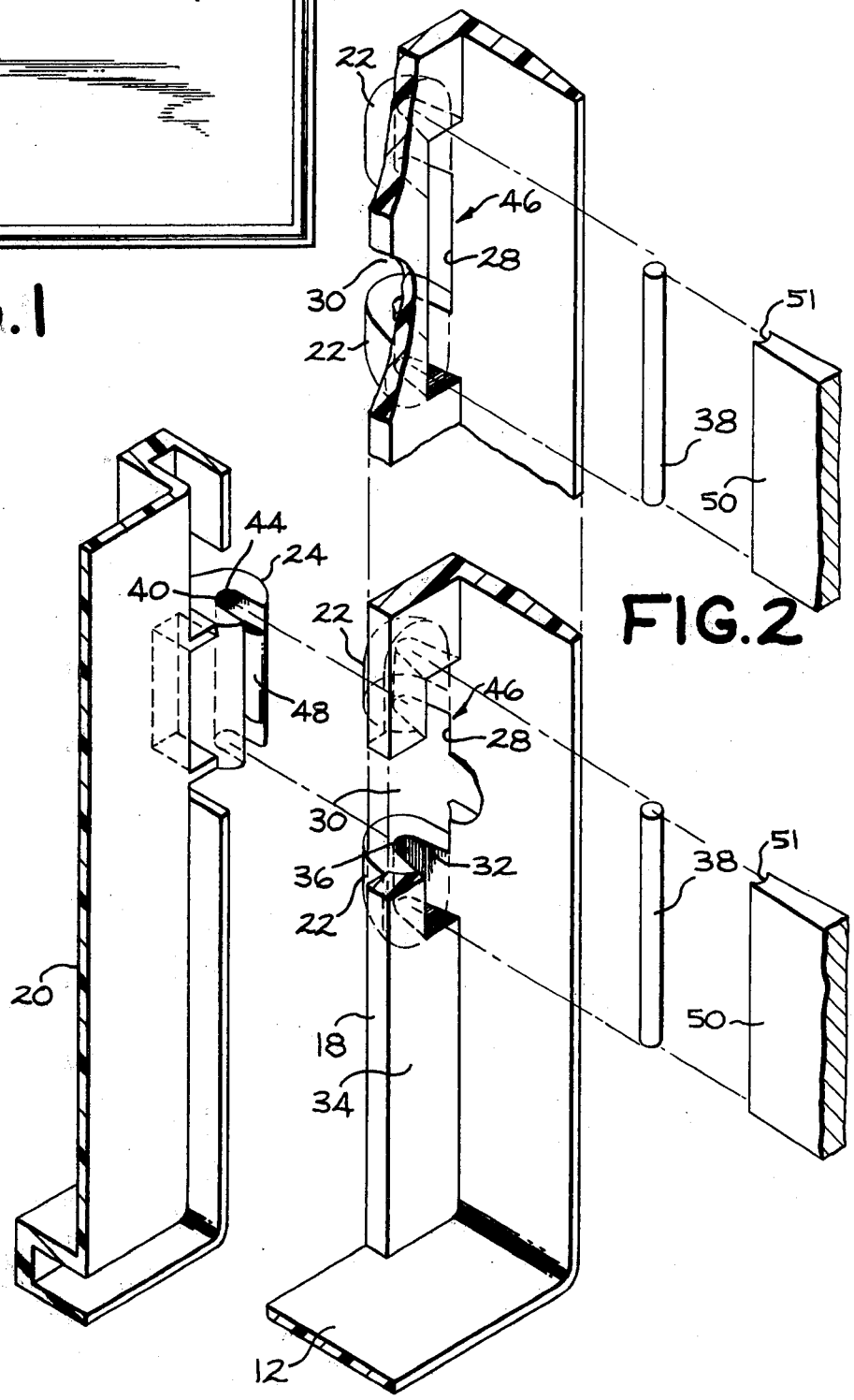
FIG. 2 is an exploded perspective view showing in detail the parts making up the present invention.

The members 22 as formed in the present embodiment are arranged to project outwardly from the surface of the front wall 26 of the panel 12. The support members 22 (FIGS. 7 and 8) are spaced to receive the hinge members 24 therebetween. The panel 12 includes an aperture 28 that extends between the members 22 to complete a receiving area 30 for hinge member 24, as will be fully explained hereinafter. With reference to FIGS. 2, 7 and 8, it will be seen that a notch or recess 32 is provided in each of the support members 22. The notches 32 have their longitudinally disposed opening in communication with the rear wall portion 34 of panel 12 with their axial ends opening into the aperture 28 or receiving area 30. In this arrangement, the bottom portion 36 of the notches 32 are axially aligned and shaped to receive a hinge pin 38, as will be explained hereinafter. With reference to FIGS. 2 and 8, it will be noted that the aperature 28, together with the notch 32 opening into the rear wall 34 of panel 12, provides an access opening for hinge pin 38.

As mentioned hereinbefore, the hinge member 24 of the hinge arrangement 21 is dimensioned to be positioned in the receiving area 30 between the members 22, as shown in FIGS. 1 and 8. The member 24 includes a longitudinally disposed slot 40 extending the full length of member 24. The longitudinally disposed open portion of slot 40 communicates with opening 28 when the member 24 is positioned between member 22 in the door closed position. As shown in FIG. 8, the longitudinally arranged openings of notches 32 and slot 40 align to form a continuous channel 46 for receiving hinge pin 38. It should also be noted that the bottom hinge pin receiving portion 44 of slot 40 in this position is substantially in axial alignment with bottom hinge pin receiving portion 36 of the notch 32.

In assembling the hinge arrangement 21 (FIG. 5) in accordance with the present method, the cover 20 including the hinge members 22 is arranged on the front wall 26 of panel 12 in its cover closed position, with the member 24 arranged between the support members 22 as shown in FIG. 6. In this position, the bottom portions 36 of the notches 32 and the portion 44 of slot 40 are axially aligned and the openings 42 of slot 40 is aligned with the opening of notches 32 in wall portion 34 to form the continuous channel 46. In the next step, the pivot or hinge pin 38 is then placed in the channel 46 and moved into the aligned bottom portions 36, 44 of the notches 32 and slot 40, respectively, as shown in FIG. 3 by an appropriate tool member 50.

Means are provided for maintaining the hinge pin 38 in its assembled position. To this end a holding means or cam surface 48 is provided on one wall of the slot 40. The cam 48 projects from the side wall of the slot 40 and is arranged between the opening 42 and the bottom portion 44. It should be easily understood that in its assembled position the hinge pin 38 is forced past cam 48 by tool 50 and is trapped or secured between the bottom portions 36 of notches 32 and the cam 48 in slot 40 for securely holding member 24 in its assembled position on members 22 during normal rotational operation of the cover 20 relative to panel 12. However, it should be noted that in its closed position the cover 20, if necessary, may be forcefully removed from the panel 12 as the member 24 will yield to allow passage of pin 38 as it did during the time the pin 38 was forced past the cam 48 in assembling the hinge.

The tool 50 may conveniently include a concave portion 51 that engages the pin 38. It should further be noted that the tool 50 may be magnetic to hold the pin 38 during the assembling process as it is inserted into channel 46 past the holding means 48.

In summary, a hinge arrangement 21 is provided wherein rotational movement of the cover 20 relative to the panel 12 is afforded while, at the same time, preventing removal of the cover from the panel when the cover is moved from its closed position as shown in FIG. 4. In the open position of the cover 20, or as it rotates from its closed position, the opening 42 of slot 40 which was aligned with the notch openings to form channel 46 is deposed radially relative to the notch openings as shown in FIG. 4; and, accordingly, the hinge pin 38 is trapped between the members 22 and 24. This arrangement is effective in preventing the removal of cover 20 from panel 12 when the cover is rotated from its closed position. Securing the cover 20 against removal from panel 12 when it is rotated away from its closed position is desirable in that it is when cover 20 is moved from its closed position that it is susceptible to abuse by the user of the unit, such as the application of leverage on the hinge assembly 21 by employing excessive weight on the open cover 20.

The foregoing is a description of the preferred embodiment of the invention and variations may be made thereto without departing from the true spirit of the invention, as defined in the appended claims.

What is claimed is:

1. A room air conditioner unit including a control means, a front panel member having an opening communicating with said control means, a cover hingedly mounted on said panel being rotatable between a closed position over said opening to an open position to provide access to said control means through said opening, a plurality of hinge means, each comprising:

a pair of support members formed integral with the front wall portion of said panel, being arranged on the axial ends of an aperture in said panel to form a receiving area between said support members;

axially aligned notch means opening in the rear wall portion of said panel extending into said support members being arranged so that their axial ends extend into said opening in said receiving area;

a hinge member formed integral with said cover being dimensioned to be positioned in said receiving area between said support members;

a longitudinally disposed slot in said hinge member having its opening communicating with said opening in said panel being in axial alignment with said notches in said support members to provide a continuous channel area including the open portion of said notches and slots communicating with said rear wall portion when said hinge member is positioned in said receiving area in its closed cover position;

a pivot pin arranged in said channel area for allowing rotational movement of said cover relative to said panel, while preventing removal of said cover from said panel when it rotates from its open position inasmuch as said pivot pin is trapped between the hinge member and the support members when said cover is rotated from its closed position and the slot opening in said hinge member forming a portion of said channel is disposed radially relative to the openings of said notches.

2. The invention as recited in claim 1 wherein holding means are provided in said slot for locating said pivot pin in said slot and for maintaining axial alignment of said notches and slot.

3. A hinge arrangement comprising:

a cover hingedly mounted on a panel being rotatable between a closed position over an opening in said panel to an open position to provide access through said opening;

a pair of support members formed integral with the front wall portion of said panel, being arranged on the axial ends of an aperture in said panel to form a receiving area between said support members;

axially aligned notch means opening in the rear wall portion of said panel extending into said support members being arranged so that their axial ends extend into said opening in said receiving area;

a hinge member formed integral with said cover being dimensioned to be positioned in said receiving area between said support members;

a longitudinally disposed slot in said hinge member having its opening communicating with said opening in said panel being in axial alignment with said notches in said support members to provide a continuous channel area including the open portion of said notches and slots communicating with said rear wall portion when said hinge member is positioned in said receiving area in its closed cover position;

a pivot pin arranged in said channel area for allowing rotational movement of said cover relative to said panel, while preventing removal of said cover from said panel when it rotates from its open position inasmuch as said pivot pin is trapped between the hinge member and the support members when said cover is rotated from its closed position and the slot opening in said hinge member forming a portion of said channel is disposed radially relative to the openings of said notches.

4. The method of hingedly mounting a cover including integrally formed hinge members on a front wall portion of a room air conditioner panel having a pair of spaced apart support members which comprises:

providing said support members with axially aligned notch means opening into the rear wall portion of the panel;

providing a longitudinally disposed slot in the hinge member;

arranging the cover in its closed position so that the hinge member is between the spaced support members with the slot and notch in axial alignment and the openings of the slot and notch arranged to form a continuous channel;

placing a pivot pin in the channel with the cover in its closed position for allowing rotational movement of the cover relative to the panel while preventing removal of the cover from said panel in its open position inasmuch as the pin is trapped between the hinge member and the support members when the cover is rotated from its closed position and the slot opening in the hinge member forming a portion of the channel is disposed radially relative to the openings of the notches.

5. The method of claim 4 wherein said slot includes holding means and said pivot pin is placed in said channel past said holding means by a tool member.

* * * * *